US010172763B2

(12) United States Patent
Choi

(10) Patent No.: US 10,172,763 B2
(45) **Date of Patent: *Jan. 8, 2019**

(54) SKIN AND SCALP MASSAGING APPARATUS USING ACOUSTIC PRESSURE

(71) Applicant: EVOSONIC CO., LTD., Wonju-si, Gangwon-do (KR)

(72) Inventor: Jae Yeung Choi, Wonju-si (KR)

(73) Assignee: EVOSONIC CO., LTD., Wonju-si, Gangwon-do (KR)

( * ) Notice: Subject to any disclaimer, the term of this patent is extended or adjusted under 35 U.S.C. 154(b) by 84 days.

This patent is subject to a terminal disclaimer.

(21) Appl. No.: 14/901,489

(22) PCT Filed: Apr. 28, 2015

(86) PCT No.: PCT/KR2015/004207
§ 371 (c)(1),
(2) Date: Dec. 28, 2015

(87) PCT Pub. No.: WO2015/167195
PCT Pub. Date: Nov. 5, 2015

(65) Prior Publication Data

US 2017/0035649 A1 Feb. 9, 2017

(30) Foreign Application Priority Data

Apr. 28, 2014 (KR) ..... 10-2014-0051084

(51) Int. Cl.
*A61H 23/02* (2006.01)
*A61H 39/04* (2006.01)

(52) U.S. Cl.
CPC ..... *A61H 23/02* (2013.01); *A61H 39/04* (2013.01); *A61H 2205/02* (2013.01); *A61H 2205/021* (2013.01)

(58) Field of Classification Search
CPC .. A61H 23/02; A61H 39/04; A61H 2205/021; A61H 2205/02;
(Continued)

(56) References Cited

U.S. PATENT DOCUMENTS 4,203,431 A * 5/1980 Abura ..... A61H 7/005 15/28
4,728,934 A 3/1988 Pfander et al.
(Continued)

FOREIGN PATENT DOCUMENTS

KR 10-2011-0128410 A 11/2011
KR 10-2013-0020540 A 2/2013

OTHER PUBLICATIONS

English translation for Written Opinion IA—dated Jun. 30, 2015.*

*Primary Examiner* — Quang D Thanh
(74) *Attorney, Agent, or Firm* — Revolution IP, PLLC

(57) ABSTRACT

A skin and scalp massaging apparatus using acoustic pressure. A vibration member generates vibration using acoustic pressure induced when a sound source is generated. A vibration probe is coupled to the vibration member to receive vibration. The vibration probe has a detachably provided head having various purposes. The head is provided to massage skin or scalp. The vibration probe is coupled to a cone paper damper for generating vibration through a connection member to which the vibration member is coupled. The vibration probe is coupled to the cone paper damper of the vibration member, so that vibration is directly received, and thus, the vibration efficiency can be improved. Further, the head for the skin massage or the scalp massage is detachably provided on the vibration probe, and thus, can be used for various purposes of, for example, massaging skin, scalp, or the like.

8 Claims, 7 Drawing Sheets

(58) Field of Classification Search
CPC .... A61H 2201/0153; A61H 2201/0157; A61H 2201/0165; A61H 2201/1207; A61H 2201/1666; A61H 2201/1683; A61H 2201/1685; A61H 39/007
See application file for complete search history.

(56) References Cited

U.S. PATENT DOCUMENTS

| | | | | |
|---|---|---|---|---|
| 2004/0260212 | A1 | 12/2004 | Cho | |
| 2008/0167590 | A1 | 7/2008 | Jon et al. | |
| 2008/0209648 | A1* | 9/2008 | Taggart | A46B 13/02 15/21.1 |
| 2013/0023806 | A1* | 1/2013 | Ungemach | A61H 7/005 601/114 |
| 2014/0234005 | A1* | 8/2014 | Park | A61H 23/0218 401/4 |
| 2015/0045702 | A1* | 2/2015 | Lin | A61N 5/0616 601/19 |
| 2016/0235621 | A1* | 8/2016 | Choe | A61H 7/005 |

* cited by examiner

[Fig. 1]
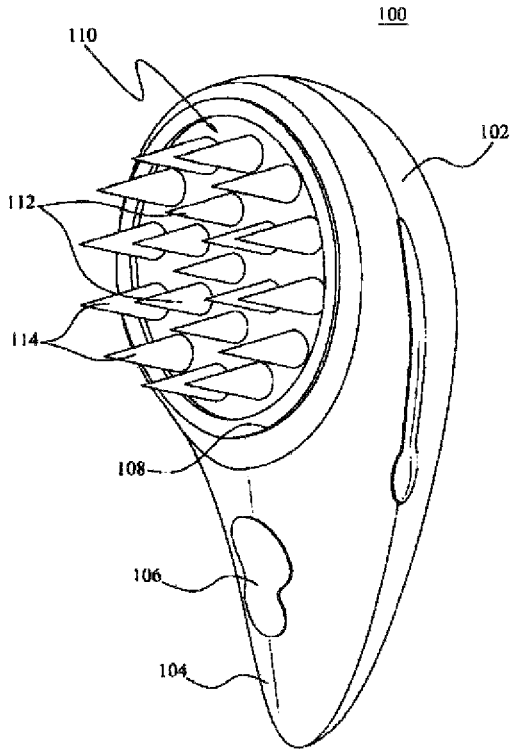
[Fig. 2]
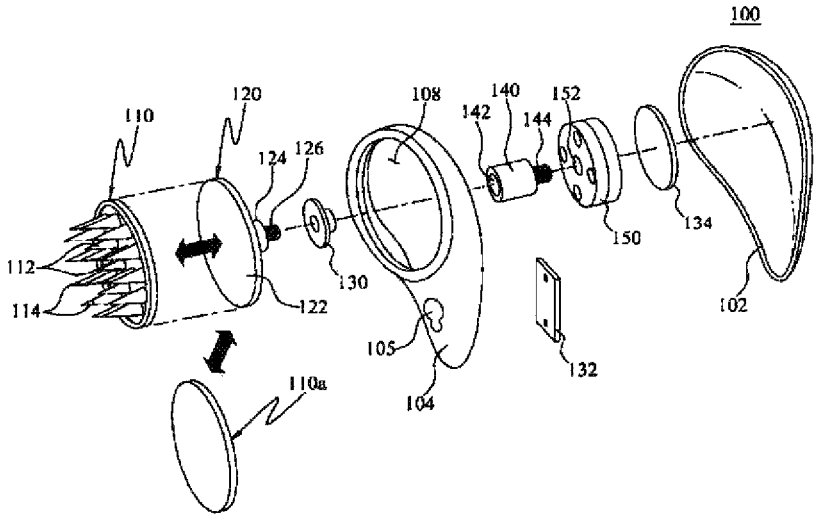

[Fig. 7a]
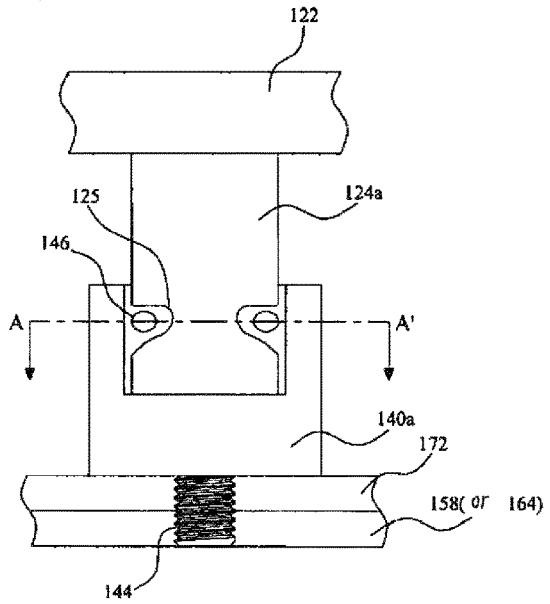
[Fig. 7b]
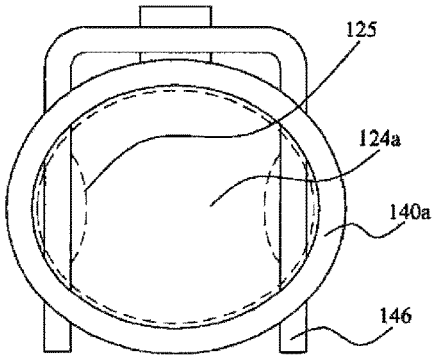
[Fig. 8]
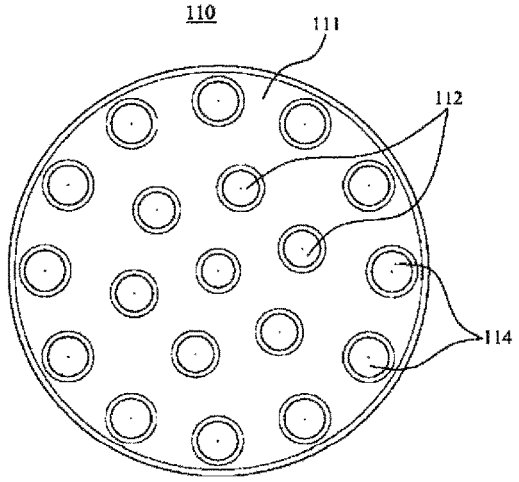

[Fig. 9]
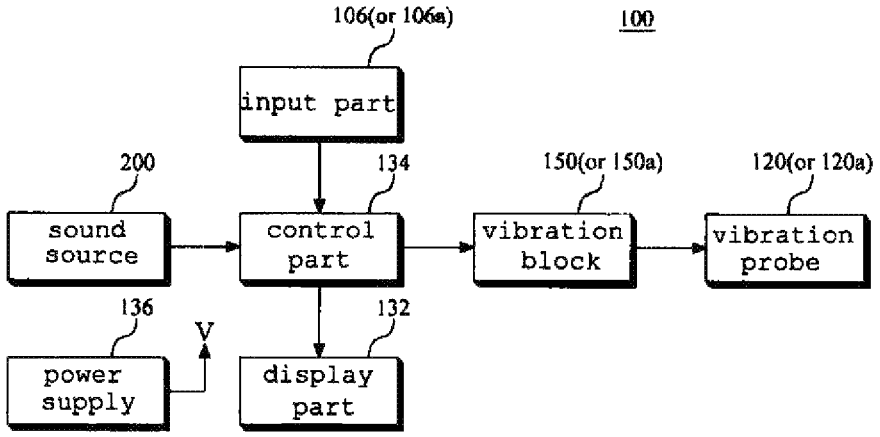

SKIN AND SCALP MASSAGING APPARATUS USING ACOUSTIC PRESSURE

TECHNICAL FIELD

The present invention generally relates to a skin and scalp massaging apparatus. More particularly, the present invention relates to a skin and scalp massaging apparatus including a vibration block using acoustic pressure induced when sound is generated, in which the skin or the scalp can be massaged by transmitting vibration from the central portion of a conduit damper of the vibration block to a vibration probe to which one of heads having a variety of applications can be detachably attached.

BACKGROUND ART

As human bodies age with the lapse of time, pains occur without injuries or diseases. Injuries caused by partial atrophies of muscles restrict activities. In addition, a variety of diseases, such as brain damage, myocardial infarction, atherosclerosis, and arthritis, are caused by restricted activities due to industrial and technological development, as well as traffic accidents, industrial disasters, sports injuries, and activity-involved simple disasters. Such diseases are also caused by a variety of complications due to stress, lack of exercise, obesity, etc.

In order to treat pains, damages, obesity, and the like occurring due to natural processes of humans or social and cultural problems as described above, not only medicines and health foods but also a variety of stimulating devices have been developed and are used. Such stimulating devices include a massaging device.

In general, a massaging device is a device to beat, rub, or stimulate the skin or the scalp in order to promote blood circulation, lipolysis, and waste discharge. Such a massaging device generates vibration or electric stimulation using electrical signals and applies generated vibration or electric stimulation to the skin or the scalp. For example, the massaging device is divided into a low-frequency massaging device that massages a human body by sending a low frequency current through the human body using electrodes attached to the skin, a supersonic massaging device that transmits ultrasonic waves to the human body using an ultrasonic probe contacting the surface of the skin, and a massaging device using an ultra-low frequency, far infrared (FIR) radiation, or the like.

However, currently-used technologies of stimulating human bodies using vibration include a large number of approaches that are currently applied and used. Examples thereof include a straight stimulus approach using a simple rotary vibration motor and a solenoid, a pressing method using air pressure, a stimulator inducing muscles to contract by inputting a low-frequency current thereto, a method of contracting muscles using a magnetic field, and the like. However, these approaches operate at a level in which pressure or stimulus is simply applied to human bodies, and the technological levels thereof are limited.

For example, referring to the structure and characteristics of a vibrator using a motor, it is possible to adjust the number of vibrations, but the amplitude or intensity of vibration cannot be adjusted. Thus, the vibrator may be erroneously used, causing injury to a human body. In addition, vibrations may not be rhythmically transmitted.

Recently, stimulation methods compensating for such problems by using a principle of audio speakers have been provided. However, such methods fail to realize a desired level of intensity that may be effectively felt, and merely provide a function similar to a subwoofer in a speaker system.

In addition, an approach using a low-frequency current, an approach using ultrasonic waves, an approach using high frequencies, and the like have been disclosed and used. However, the low-frequency approach may cause significant inconvenience to users, and in the case of the ultrasonic approach, a user may not readily feel an effect. In addition, since affected parts are exposed, a medium for transmitting low-frequency or ultrasonic vibration is required, which is a critical problem in use.

High frequency devices are directed to generating deep heat rather than functioning as stimulation devices. In addition, users may be subjected to a danger considering the characteristics of high frequencies. In the case of high-frequency devices, affected parts need to be exposed, and a medium is required. In addition, conducting plates used for transmitting electricity to opposite poles may be dangerous, and significant inconvenience in use is caused.

Low-frequency treatment devices repeatedly apply a pulse of low-frequency current to the skin. Thus, patients have an uncomfortable feeling of being electrically shocked while being treated, whereby the effect of treatment is reduced, which his problematic. In addition, low-frequency treatment devices required affected parts to be exposed in order to attach electrodes to the skin. Thus, female patients evade such treatment.

In addition, ultrasonic treatment and beauty devices transmit ultrasonic vibration to the skin when a skin contact area of an ultrasonic probe makes contact with the skin. However, there are a variety of problems. For example, when the probe contacts the skin in an erroneous way, ultrasonic vibration is not transmitted, and a sufficient effect cannot be obtained. Since a certain level of ultrasonic vibration set by a user is emitted regardless of whether or not the probe contacts the skin, when the probe does not contact the skin, the portion of the probe that transmits vibration is heated due to vibration. When the temperature of this portion of the probe rises, the user may feel uncomfortable. When the device is used for a long period of time, the skin may be burned.

Furthermore, a variety of approaches able to realize a variety of skin care modes using a vibrator vibrating in the vertical direction using a magnetic coil and to provide galvanic massages and iontophoretic massages using the vibrator are disclosed.

However, such approaches of the related art are directed to stimulating the skin by converting the rotating force of a vibration motor into a linear motion or a cam motion. Thus, noises occur while the driving force of the vibration motor is being transmitted, thereby causing discomfort the users of beauty devices. Since vibration is caused by eccentricity, there is a significant amount of diverging force in the horizontal direction, i.e. the direction parallel to the surface of the skin. This reduces an amount of force acting to the surface of the skin in the perpendicular direction. Consequently, massaging is not effectively performed, which is problematic.

In addition, an apparatus of generating sound waves and a device able to generate a sound source based on the principle of an audio speaker have been developed. However, due to certain problems, such as the structural characteristics of a magnetic circuit and the positions of a leaf spring and a coil, the amplitude of frequencies generated thereby is limited, and the intensity thereof is very low. In addition, since a guide using a bearing for maintaining acoustic vibration in a vertical form as well as a coil spring for maintaining elasticity is required, it is difficult to reduce the size thereof.

Furthermore, it is difficult to effectively care for human bodies using the related-art approaches, since the modes of use and functions thereof are significantly limited. According to the related-art approaches, a user must keep pressing a vibrator against his or her body in order to provide stimulation. Consequently, the user may quickly become tired, which is problematic.

DISCLOSURE

Technical Problem

An object of the present invention is to provide a skin and scalp massaging apparatus including a vibration block using acoustic pressure generated from sound.

Another object of the present invention is to provide a skin and scalp massaging apparatus using acoustic pressure, the apparatus including a vibration probe to which one of a variety of skin and scalp massaging heads is detachably attached and a vibration block efficiently transmitting vibration to the vibration probe.

A further object of the present invention is to provide a skin and scalp massaging apparatus using acoustic pressure, the apparatus having an engagement structure for directly transmitting vibration between a vibration probe and a vibration block.

Technical Solution

In order to achieve the above object, a skin and scalp massaging apparatus according to the present invention is directed to efficiently transmitting vibration using a head detachably attached to a vibration probe engaged with the central portion of a conduit damper of a vibration block. The skin and scalp massaging apparatus provides a variety of uses of massaging skin or scalp. Since the amplitude of vibration generated by the central portion of the conduit damper is greatest, it is possible to improve vibration efficiency for massaging or stimulation by engaging the central portion of the conduit damper of the vibration block with the vibration probe.

According to an aspect of the present invention, a skin and scalp massaging apparatus using acoustic pressure includes: a housing; a vibration block disposed in an inner space of the housing, wherein the vibration member comprises a disk-shaped conduit plate generating vibration in a vertical direction in response to changes in acoustic pressure generated from sound, and a plurality of strip-shaped dampers extending along a circumference of the conduit plate; a vibration probe engaged with the vibration block to be exposed externally from the housing; a connecting member transmitting vibration generated by the vibration block to the vibration block, wherein one end of the connecting member is engaged with the vibration probe, and the other end of the connecting member is engaged with a central portion of the conduit damper; and a head detachably attached to the vibration probe to massage skin or scalp of a human body using vibration received from the vibration probe.

According to an embodiment of this aspect, the vibration probe includes a plate to which the skin or scalp massaging head is detachably attached, and a shaft disposed on a central portion of a bottom surface of the plate, a bottom end of the shaft being engaged with the connecting member.

According to another embodiment, the vibration block includes: a body including a lower body having an opened upper portion and an inner accommodation space and an upper body covering the opened upper portion of the lower body, the upper body having a first engagement hole through which the connecting member extends to be fitted thereinto; a magnetic member disposed within the accommodation space to generate magnetic force; a voice coil disposed around the magnetic member within the accommodation space; an upper plate having a second engagement hole corresponding to the first engagement hole, the connecting member being engaged with the second engagement hole, wherein the upper plate is disposed on top of the voice coil to induce magnetic force from the magnetic member to be concentrated to the voice coil; and a conduit damper having a third engagement hole corresponding to the second engagement hole, the connecting member being engaged with the third engagement hole, wherein the conduit damper is disposed on top of the upper plate, is engaged between the upper body and the lower body, and generates vibration in a vertical direction using an interaction between the magnetic member and the voice coil.

According to a further embodiment, an upper portion of the connecting member is screw-engaged with a bottom end of the shaft, and a lower portion of the connecting member is engaged with the third engagement hole of the conduit damper and the second engagement hole of the upper plate.

According to another embodiment, the vibration block includes: a body including a lower body having an opened upper portion and an inner accommodation space and an upper body covering the opened upper portion of the lower body, the upper body having a first engagement hole through which the connecting member extends to be fitted thereinto; a lower bracket disposed in the accommodation space of the body, with an upper portion and a lower portion of the lower bracket being opened; a magnetic member disposed within the accommodation space to generate magnetic force; a voice coil disposed around the magnetic member within the accommodation space; an upper plate disposed on top of the voice coil to induce magnetic force from the magnetic member to be concentrated to the voice coil; a bobbin having a second engagement hole in a central portion of an upper surface thereof, the connecting member being engaged with the second engagement hole, wherein the bobbin guides the voice coil to be disposed around the magnetic member; a conduit damper having a third engagement hole corresponding to the second engagement hole, the connecting member being engaged with the third engagement hole, wherein the conduit damper is disposed on top of the upper plate to generate vibration in a vertical direction using an interaction between the magnetic member and the voice coil; and an upper bracket engaged with the lower bracket and disposed within the accommodation space of the body, the upper bracket having a fourth engagement hole corresponding to the third engagement hole, the connecting member being fitted into and extending through the fourth engagement hole, According to a further embodiment, the conduit damper includes: a disk-shaped conduit plate generating vibration in a vertical direction; and a plurality of dampers extending along a circumference of the conduit plate, each of the dampers being an arc-shaped strip that is curved outward, and having a screw-engagement hole in a distal end thereof, wherein the dampers are fixedly engaged between the upper bracket and the lower bracket.

According to another embodiment, an upper portion of the connecting member is screw-engaged with a bottom end of the shaft, and a lower portion of the connecting member is screw-engaged with the fourth engagement hole of the upper bracket, the third engagement hole of the conduit damper, and the second engagement hole of the bobbin.

According to a further embodiment, the vibration probe has a fixing recess formed in a predetermined position on an outer circumference of the shaft, and the connecting member has an engagement recess in an upper portion thereof into which the shaft is removably fitted, and an elastic fixing pin is fixedly disposed on the connecting member, wherein the elastic fixing pin is seated in or separated from the fixing recess when the shaft is fitted into or separated from the engagement recess.

Advantageous Effects

As set forth above, in the skin and scalp massaging apparatus according to the present invention, the vibration probe is engaged with the central portion of the conduit damper of the vibration block such that vibration is directly transmitted to the vibration probe. Since the amplitude of vibration generated by the central portion of the conduit damper is greatest, vibration efficiency for massaging or stimulation can be improved.

In addition, the skin and scalp massaging apparatus according to the present invention can be applied to a variety of uses of, for example, massaging skin or scalp, since the heads can be detachably attached to the vibration probe.

Furthermore, in the skin and scalp massaging apparatus according to the present invention, the conduit damper has a plurality of dampers and is engaged with the components of the vibration block via the plurality of dampers. Accordingly, the apparatus has a simplified structure, and is easy to assemble.

In addition, in the skin and scalp massaging apparatus according to the present invention, the vibration probe is engaged with the vibration block by screw-engagement or by means of the connecting member engaged with the fixing recess via the elastic fixing pin. Accordingly, the apparatus can be easily mounted, separated, and assembled.

Furthermore, in the skin and scalp massaging apparatus according to the present invention, the vibration block has a plurality of heat dissipation holes, such that heat can be easily dissipated while vibration is being generated.

In addition, in the skin and scalp massaging apparatus according to the present invention, the vibration probe is engaged with the vibration block via the connecting member, such that the vibration probe can be designed and fabricated in a variety of shapes.

DESCRIPTION OF DRAWINGS

FIG. 1 is a perspective view illustrating the configuration of a skin and scalp massaging apparatus according to a first embodiment of the present invention;

FIG. 2 is an exploded perspective view illustrating the configuration of the skin and scalp massaging apparatus illustrated in FIG. 1;

FIGS. 7*a* and 7*b* are views illustrating an assembly structure of a vibration probe and a connecting shaft according to another embodiment of the present invention;

FIG. 8 is a top-plan view illustrating the configuration of the skin and scalp massaging first head illustrated in FIGS. 1 to 3; and FIG. 9 is a block diagram illustrating the configuration of the skin and scalp massaging apparatus according to the present invention.

MODE FOR INVENTION

Figure 3:
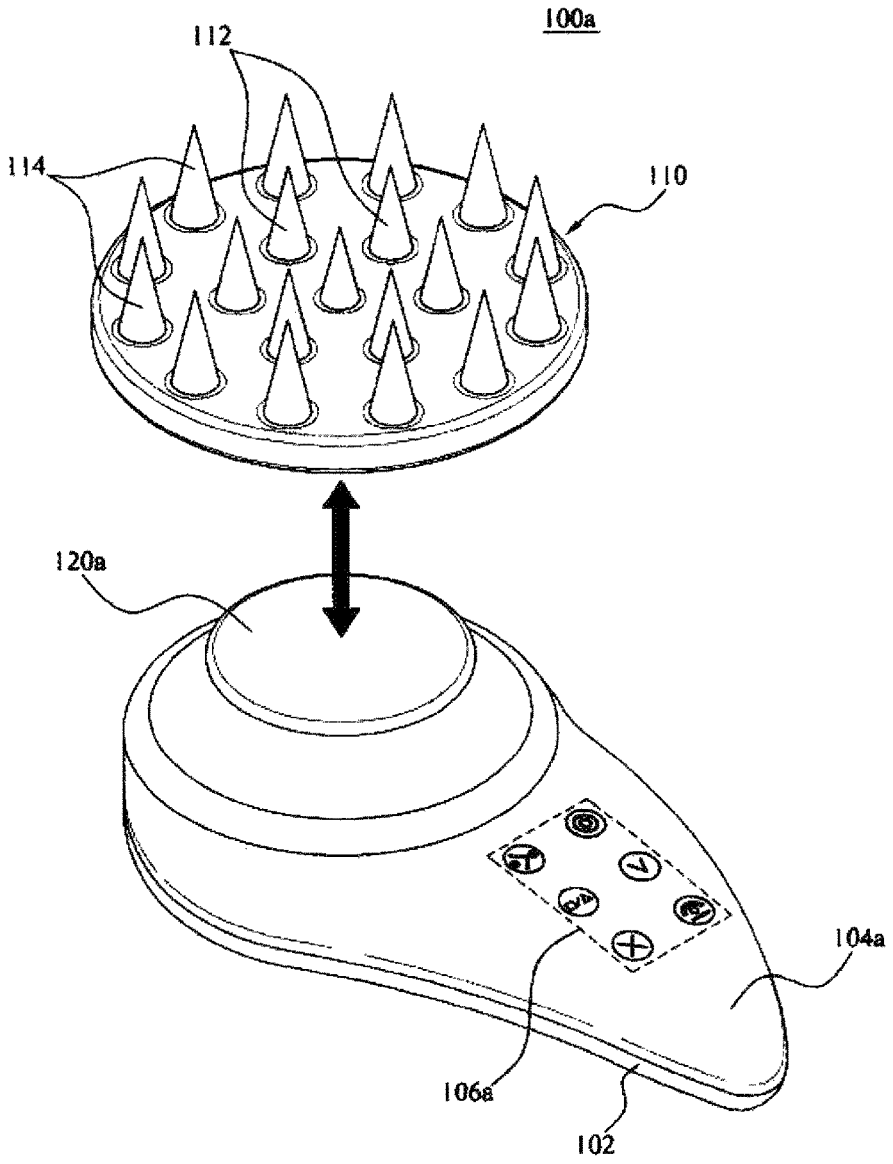
FIG. 3 is a; perspective view illustrating the configuration of a skin and scalp massaging apparatus according to a second embodiment of the present invention.

The present invention may be embodied in many different forms and the scope of the present invention should not be construed as being limited to only the embodiments set forth herein. These embodiments are provided so that this disclosure will fully convey the scope of the present invention to those skilled in the art. In the drawings, the shapes and dimensions of components may be exaggerated for the sake of clarity.

Hereinafter, the embodiments of the present invention will be described in detail with reference to FIGS. 1 to 6.

FIG. 1 is a perspective view illustrating the configuration of a skin and scalp massaging apparatus according to a first embodiment of the present invention, and FIG. 2 is an exploded perspective view illustrating the configuration of the skin and scalp massaging apparatus illustrated in FIG. 1.

Referring to FIGS. 1 and 2, the skin and scalp massaging apparatus 100 according to the first embodiment includes a vibration block 150 that generates vibration using acoustic pressure and directly transmits vibration to a vibration probe 120, to which heads 110 and 110*a* having a variety of uses are detachably attached, in order to massage a person's skin or scalp.

Specifically, the skin and scalp massaging apparatus 100 according to the present embodiment includes housings 102 and 104, the vibration block 150, the vibration probe 120, and selectively one of the heads 110 and 110*a* having different shapes. In addition, the skin and scalp massaging apparatus 100 includes an input part 106, a waterproof member 130, a connecting member 140, a control circuit board 134, and a display module 132.

The housings 102 and 104 accommodate the vibration block 150 fixedly disposed in the inner space thereof, and have a first opening 108 and a second opening 105 in partially-opened portions thereof. The first opening 108 allows the vibration probe 120 to be exposed through the outer surface of the housings, and the input part 106 and the display module 132 are mounted into the housings through the second opening 105. In addition, the control circuit board 134 driving the vibration block 150 in response to acoustic pressure generated using source and the display module 132 displaying the operating state of the skin and scalp massaging apparatus 100 are fixedly disposed in the inner space of the housings 102 and 104.

The housings 102 and 104 include the upper housing 104 and the lower housing 102. The upper and lower housings 102 and 104 are engaged with each other, defining the inner space thereof in which the vibration block 150 is fixedly disposed. The upper housing 104 and the lower housing 102 are engaged with each other in a sealing manner by means of a sealing member (not shown) formed of a silicone material.

The control circuit board 134 is fixedly disposed on one inner portion of the lower housing 102, and the display module 132 is fixedly disposed on the other inner portion of the lower housing 102. The vibration block 150 is fixedly disposed on the upper portion of the lower housing 102 in which the control circuit board 134 is disposed.

The upper housing 104 has the partially-opened first opening 108 in a position facing the vibration block 150 fixedly disposed in the lower housing 102. In the first opening 108, the vibration probe 120 engaged with the vibration block 150 is exposed through the outer surface of the upper housing 102. A deco-ring is disposed between the circumference of the first opening 108 and the circumference of the head 110 or 110*a* mounted on the vibration probe 120.

The skin and scalp massaging apparatus 100 according to the first embodiment is provided in the shape in which the vibration probe 120 disposed in the first opening 108 of the upper housing 102 is buried inward from the surface of the upper housing 102. Thus, the exposed surface of the skin massaging head 110*a* or the scalp massaging head 110 engaged with the vibration probe 120 is provided to be substantially parallel to the surface of the upper housing 102.

In addition, the upper housing 104 has the second opening 105 below the first opening 108. The input part 106 and the display module 132 are disposed in the second opening 105.

The input part 106 includes, for example, a plurality of input buttons, a power switch, and the like. The input part 106 Supplies power to the skin and scalp massaging apparatus 100, controls the intensity of vibration generated by the vibration block 150, or controls the operation modes, such as start, pause, or stopping of an operation, of the skin and scalp massaging apparatus 100.

Different shapes of the heads 110 and 110*a* may be selectively provided in such that the heads 110 and 110*a* can be used for different uses. For example, the heads 110 and 110*a* include the skin massaging head 110*a* and the scalp massaging head 110. Each of the heads 110 and 110*a* is detachably disposed on the vibration probe 120. The heads 110 and 110*a* may be formed of a variety of materials, such as a silicone, wood, plastic, and metal. Each of the heads 110 and 110*a* is disposed on the vibration probe 120 to transmit vibration to the skin or the scalp of a human body in order to massage the skin or the scalp.

The bottom surface of the scalp massaging head 110 is fitted into the vibration probe 120, and a plurality of protrusions 112 and 114 are provided on the top surface of the scalp massaging head 110. In addition, the surface of the skin massaging head 110*a* that makes contact with the skin is shaped to be substantially flat or is shaped such that the central portion thereof is convexly rounded.

The upper portion of the vibration probe 120 is exposed in the first opening of the housings 102 and 104, and the lower portion of the vibration probe 120 is engaged with the vibration block 150. The vibration probe 120 vibrates the head 110 or 110*a* by receiving, vibration directly from the vibration block 150. The vibration probe 120 includes a plate 122 to which the head 110 or 110*a* is detachably attached and a shaft 124 disposed on the central portion of the bottom surface of the plate 122 and axially engaged with the vibration block 150. The shaft 124 has a bolt 126 on the bottom end, the bolt 126 being screw-engaged with the vibration block 150.

The plate 122 of the vibration probe 120 is provided in a position similar to the surface of the circumference of the first opening 108 at a distance from the circumference of the first opening 108, and is exposed externally from the upper housing 102. One of the skin massaging head 110*a* and the scalp massaging head 110 is mounted on the plate 122 of the vibration probe 120.

The waterproof member 130 is disposed between the vibration probe 120 and the vibration block 150. The waterproof member 130 is fitted around the shaft 124 of the vibration probe 120, whereby the portion between the vibration probe 120 and the vibration block 150 is maintained waterproof.

The vibration block 150 is disposed in the inner space of the housings 102 and 104. The vibration block 150 generates vibration in response to changes in acoustic pressure generated from sound, and transmits vibration generated thereby to the vibration probe 120. The vibration block 150 generates vibration in the vertical direction in response to changes in acoustic pressure. The vibration block 150 has an engagement hole 192 formed in the central portion of the top surface thereof, the engagement hole 192 being engaged with the connecting member 140. The vibration block 150 has a plurality of heat dissipation holes in the top surface thereof, through which heat is dissipated. The configuration and operation of the vibration block 150 according to the embodiments of the present invention will be described in more detail with reference to FIGS. 4 and 5.

The connecting member 140 is disposed between the vibration probe 120 and the vibration block 150. The connecting member 140 is shaft-shaped, the upper portion of the connecting member 140 is engaged with the shaft 124 of the vibration probe 120, and the lower portion of the connecting member 140 is engaged with the vibration block 150. In this regard, the connecting member 140 has an engagement recess 142 in the upper portion thereof into which the shaft 122 is engaged and the bolt 144 in the lower portion thereof that is engaged with the vibration block 150. According to the present embodiment, the engagement recess 142 is configured such that a bolt 126 of the shaft 124 is screw-engaged with the interior thereof. In addition, the vibration block 150 has the engagement hole 192 in the top surface thereof into which the bolt 144 of the connecting member 140 is screw-engaged.

The display module 132 includes, for example, at least one light-emitting diode (LED) on which the input part 106 is disposed. The LED serves to light the input part 106 and the surrounding area. The display module 132 transmits signals generated by the input part 106 to the control circuit board 134, and turns on and off the LED under the control of the control circuit board 134.

In addition, the control circuit board 134 controls the overall operations of the skin and scalp massaging apparatus 100. The control circuit board 134 controls an external power source or a power supply (136 in FIG. 9) to supply power to the skin and scalp massaging apparatus 100, and controls the operation of the skin and scalp massaging apparatus 100 in response to signals output by the input part 106. In addition, the control circuit board 134 controls the display module 132 to turn on and off the LED.

FIG. 3 is a perspective view illustrating the configuration of a skin and scalp massaging apparatus according to a second embodiment of the present invention. The skin and scalp massaging apparatus 100*a* according to the present embodiment is configured similar to the skin and scalp massaging apparatus illustrated in FIG. 1. Hereinafter, detailed descriptions will be given with regarding differences.

Referring to FIG. 3, the skin and scalp massaging apparatus 100*a* according to the second embodiment is configured such that a vibration probe 120*a* protrudes outward from housings 102 and 104*a*. Specifically, the shape and the size of a first opening of the upper housing 104*a* are determined such that the shaft of the vibration probe 120*a* extends therethrough. The vibration probe 120*a* is also configured such that a head 110 is detachably attached thereto.

In addition, the skin and scalp massaging apparatus 100*a* according to the present embodiment includes an input part 106*a* disposed in a second opening of the upper housing 104*a*, the input part 106*a* having a plurality of input buttons.

Figure 4:
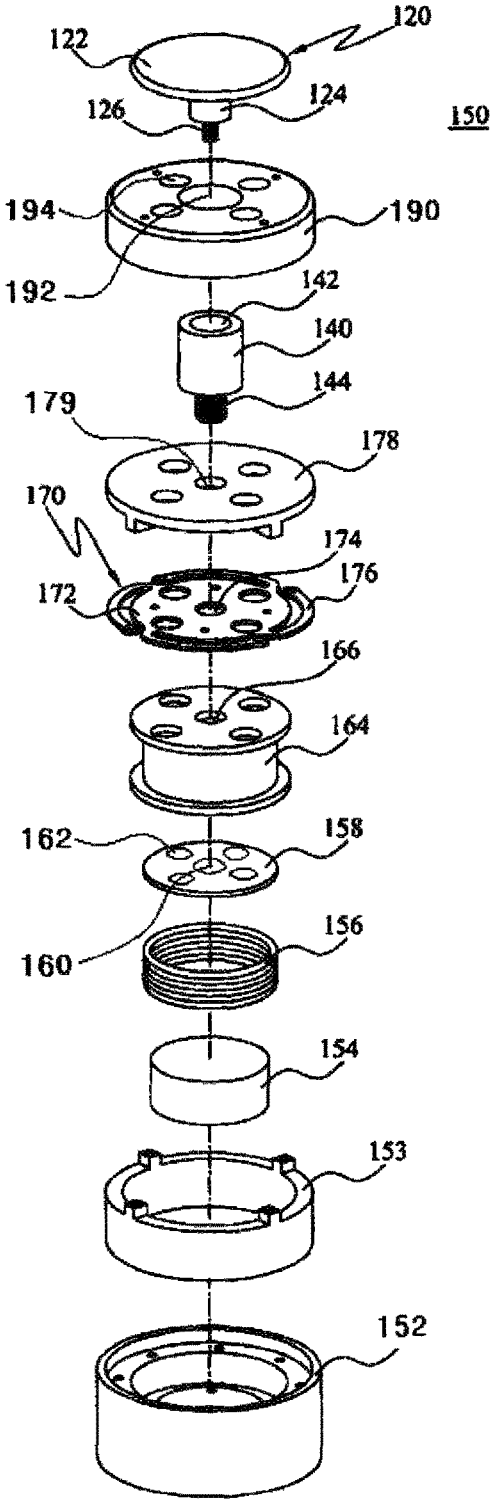
FIG. 4 is an exploded perspective view illustrating the configuration of the vibration block according to the first embodiment of the present invention.
Figure 5:
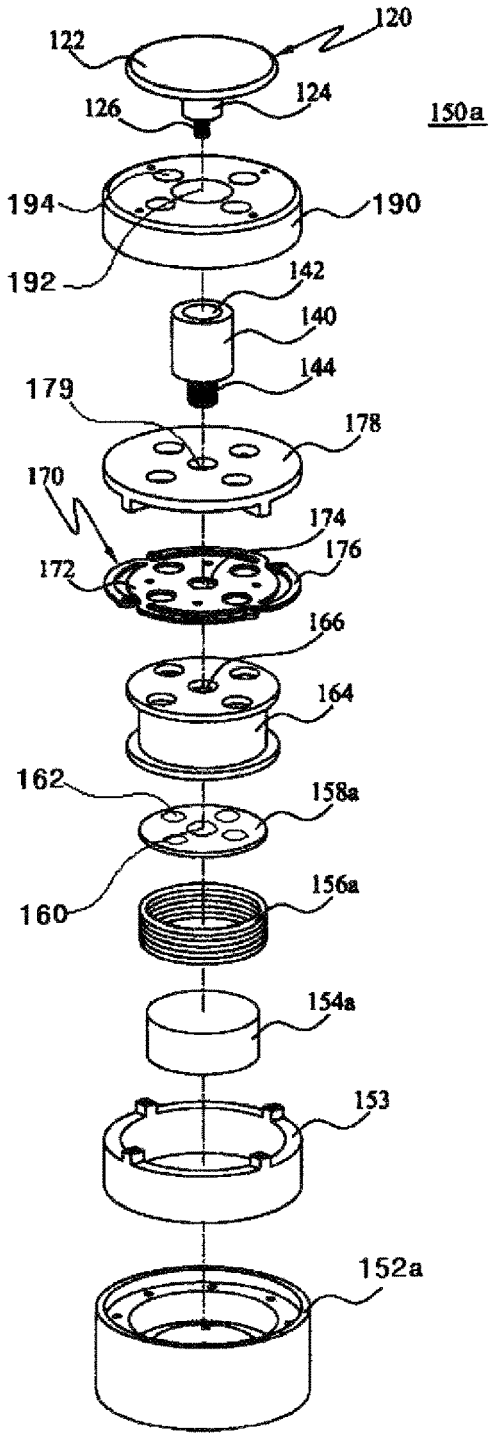
FIG. 5 is an exploded perspective view illustrating the configuration of the vibration block according to the second embodiment of the present invention.

FIG. 4 is an exploded perspective view illustrating the configuration of the vibration block according, to the first embodiment of the present invention, and FIG. 5 is an exploded perspective view illustrating the configuration of the vibration block according to the second embodiment of the present invention. The vibration blocks 150 and 150*a* according to these embodiments can be provided in the skin and scalp massaging apparatuses 100 and 100*a* illustrated in FIGS. 1 and 3.

Referring to FIG. 4, the vibration block 150 according to the present embodiment includes upper and lower bodies 190 and 152, a magnetic member 154, a voice coil 156, an upper plate 158, and a conduit damper 170. The vibration block 150 further includes a waterproof member 196 and a buffer member 180.

The lower body 152 is opened in the upper portion, and provides an inner space in which the magnetic member 154 and the voice coil 156 are accommodated. The upper body 190 is engaged with the lower body 152. The upper body 190 covers the open upper portion of the lower body 152. The upper body 190 has an engagement hole 192 and a plurality of heat dissipation holes 194. The connecting member 140 and the waterproof member 196 extend through and are fitted into the engagement hole 192.

The magnetic member 154 is fixedly disposed on the lower body 152, and interacts with the voice coil 156 to generate a magnetic field. The magnetic member 154 is implemented as a permanent magnet, for example, a neodymium magnet. The voice coil 156 is disposed outside of the magnetic member 154, and when power is applied thereto, interacts with the magnetic member 154 to generate a magnetic field.

The upper plate 158 is disposed on top of the magnetic member 154 and the voice coil 156. The upper plate 158 induces magnetic force to be concentrated to the voice coil 156. The upper plate 158 has an engagement hole 160 in the central portion thereof with which the connecting member 140 is engaged. The upper plate 158 has a plurality of heat dissipation holes 162.

The conduit damper 170 generates vibration in the vertical direction in response to acoustic pressure in the same manner as a speaker. The conduit damper 170 is disposed on top of the upper plate 158, and generates vibration in the vertical direction using a magnetic field generated by the interaction between the magnetic member 154 and the voice coil 156. The conduit damper 170 includes a disk-shaped conduit plate 172 and a plurality of dampers 176 disposed on the circumference of the conduit plate 172. The conduit plate 172 has an engagement hole 174 in the central portion thereof with which the connecting member 140 is engaged. Each of the dampers 176 is an arc-shaped strip that extends along the circumference of the conduit plate 172 and is curved outward. Each of the dampers 176 has a screw-engagement hole in the distal end thereof. The dampers 176 are fixedly screw-engaged with the top surface of the lower body 152. The conduit damper 170 directly transmits vibration to the vibration probe 120 via the connecting member 140 engaged with the central portion thereof. When the conduit damper 170 of the vibration block 150 generates vibration using acoustic pressure, the amplitude of vibration is greatest in the central portion of the conduit damper 170. Thus, the bolt 144 of the connecting member 140 and. the engagement hole 174 of the conduit damper 170 are engaged with each other to transmit vibration, whereby vibration efficiency for massaging or stimulation is maximized.

The buffer member 180 is disposed on top of the conduit damper 170 to buffer impacts such that vibration generated by the conduit damper 170 is not transmitted externally.

In addition, the waterproof member 196 is disposed between the shaft 124 of the vibration probe 120 and the upper body 190. The shaft 124 extends through the waterproof member 196 and is fixedly fitted into an engagement hole 192 formed in the central portion of the upper body 190, thereby preventing external liquid or impurities from entering the interior of the vibration block 150.

In the vibration block 150, the shaft 124 of the vibration probe 120 extends through the central portion of the upper body 190 and is engaged with the connecting member 140, and the connecting member 140 is screw-engaged with the central portions of the conduit damper 170 and the upper plate 190. Consequently, in the vibration block 150, when the conduit damper 170 generates vibration in the vertical direction using acoustic pressure generated from sound, vibration is transmitted to the vibration probe 120 engaged with the conduit damper 170 via the connecting member 140.

The second embodiment will be described with reference to FIG. 5, According to the present embodiment, the vibration block 150*a* includes upper and lower bodies 190 and 152*a*, upper and lower brackets 178 and 153, a magnetic member 154*a*, a voice coil 156*a*, an upper plate 158*a*, a bobbin 164, and a conduit damper 170. Although not shown in the drawings, the vibration block 150*a* may further include a waterproof member and a buffer member, as illustrated in FIG. 4.

The lower body 152*a* is opened in the upper portion, and has an inner space in which the magnetic member is accommodated. The magnetic member 154*a* is fixedly disposed on the bottom of the inner space of the lower body 152*a*. In addition, a lower bracket 153 is disposed in the lower body 152*a*, in a position surrounding the magnetic member 154*a*. The upper body 190 is engaged with the lower body 152*a*, thereby covering the open upper portion of the lower body 152*a*.

The upper portion and the lower portion of the lower bracket 153 are opened. The lower bracket 153 is disposed within the lower body 152*a*, with the top surface thereof being engaged with the conduit damper 170. The upper bracket 178 is disposed within the upper body, and is engaged with the upper portion of the lower bracket 153. The bottom surface of the upper bracket 178 is screw-engaged with the conduit damper 170 and the lower bracket 153.

The magnetic member 154*a* is fixedly disposed in the lower body 152*a* to interact with the voice coil 156*a* to generate a magnetic field. The magnetic member 154*a* is implemented as a permanent magnet, for example, a neodymium magnet. The voice coil 156*a* is disposed outside of the magnetic member 154*a*, and when power is applied thereto, interacts with the magnetic member 154*a* to generate a magnetic field. The magnetic member 154*a* and the voice coil 156*a* are disposed within the upper and lower brackets 178 and 153, which enhance the efficiency of generation of the magnetic field.

The upper plate 158*a* is disposed on top of the magnetic member 154*a* and the voice coil 156*a*, and is positioned in the inner diameter portion of the bobbin. The upper plate 158*a* induces magnetic force generated by the magnetic member 154*a* to be concentrated to the voice coil 156*a*.

The bobbin 164 is engaged with the vibration probe 120. The bobbin 164 guides the voice coil 156*a* to be reliably disposed outside thereof, and prevents the voice coil 156*a* from being dislodged. The bobbin 164 has an engagement hole 166 in the central portion of the upper surface with which the connecting member 140 is engaged and a plurality of heat dissipation holes surrounding the engagement hole 166. The heat dissipation holes function to reduce noise when vibration is generated while performing a heat dissipation function. In addition, the bobbin 164 dissipates heat generated by the voice coil 156*a*.

The conduit damper 170 is disposed on top of the bobbin 164, and generates vibration in the vertical direction using a magnetic field generated by the interaction between the magnetic member 154 and the voice coil 156. The conduit damper 170 includes a conduit plate 172 and a plurality of dampers 176. The conduit plate 172 has an engagement hole 174 in the central portion thereof with which the connecting member 140 is engaged. Each of the dampers 176 is an arc-shaped strip that extends along the circumference of the conduit plate 172 and is curved outward. Each of the dampers 176 has a screw-engagement hole in the distal end thereof. The dampers 176 are fixedly screw-engaged between the upper and lower brackets 178 and 153. The conduit damper 170 directly transmits vibration to the vibration probe 120 via the connecting member 140 engaged with the central portion thereof. Since the amplitude of vibration is greatest in the central portion of the conduit damper 170, a bolt 144 of the connecting member 140 and the engagement hole 174 of the conduit damper 170 are engaged with each other to transmit vibration to the vibration probe 120 via the connecting member 140.

Thus, in the vibration block 150*a* according to the present embodiment, the shaft 124 of the vibration probe 120 extends through the central portion of the upper body 190 and is engaged with the connecting member 140, and the connecting member 140 is screw-engaged with the central portions, of the upper bracket 178, the conduit damper 170, and the bobbin 164 through engagement holes 179, 174, and 166, respectively. Consequently, in the vibration block 150*s*, when the conduit damper 170 generates vibration in the vertical direction using acoustic pressure generated from sound, vibration is transmitted to the vibration probe 120 engaged with the conduit damper 170 via the connecting member 140.

Figure 6:
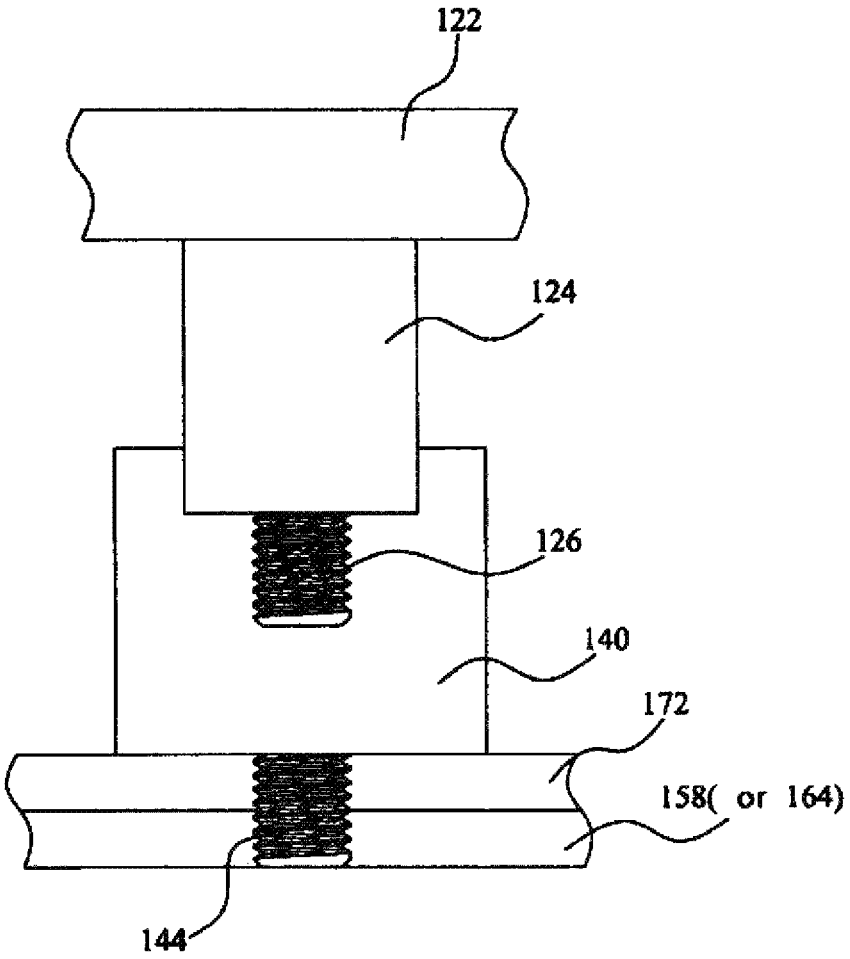
FIG. 6 is a view illustrating an assembly structure of a vibration probe and a connecting shaft according to an embodiment of the present invention.

FIG. 6 is a view illustrating an assembly structure of a vibration probe and a connecting shaft according to an embodiment of the present invention, and FIGS. 7*a* and 7*b* are views illustrating an assembly structure of a vibration probe and a connecting shaft according to another embodiment of the present invention.

First, referring to FIG. 6, the vibration probe 120 according to the present embodiment is screw-engaged with the connecting member 140 by means of the bolt 126 of the shaft 124, with the bolt 144 of the connecting member 140 being screw-engaged with the central portion of the conduit plate 172, the upper plate 158, or the bobbin 164 of the vibration block 150*a*, as illustrated in FIGS. 1 to 5, in order to directly receive vibration generated by the conduit damper.

Referring to FIGS. 7*a* and 7*b*, the vibration probe 120 according to the present embodiment has fixing recesses 125 in specific positions of the outer circumference of the shaft 124*a*. Elastic fixing pins 146 are fixedly disposed on the connecting member 140*a*, the elastic fixing pins 146 being removably fitted into the fixing recesses 125.

Each of the fixing recesses 125 has a catching stepped portion on the upper portion and a guide on the lower portion. In addition, each of the elastic fixing pins 146 is fixed in an outside position such that a portion thereof is exposed within the corresponding engagement recess 142 of the connecting member 140. The exposed portion of each elastic fixing pin 146 is fitted into or separated from the corresponding fixing recess 125 of the shaft 124*a*.

The fixing recess 125 is configured such that, when the shaft 124*a* of the vibration probe 120 is pressed downwards to be fitted into the engagement recess 142 of the connecting member 140*a*, each elastic fixing pin 146 is guided by a guide to be seated in the fixing recess 125, and at the same time, the elastic fixing pin 146 is fixedly held by the catching stepped portion. In addition, when the shaft 124*a* is pressed upwards to be separated from the engagement recess 142 of the connecting member 140*a*, each elastic fixing pin 146 is easily separated from the fixing recess 125 by means of the guide.

According to the present embodiment, the vibration probe 120 can be engaged with and separated from the vibration block 150 more easily than in the case of screw engagement illustrated in FIG. 6. It is also possible to prevent threads from damage that would otherwise occur as the vibration probe 120 is multiply engaged with and separated from the vibration block 150.

Thus, the vibration probe 120 according to the present invention can be easily fabricated and assembled since the connecting member 140 or 140*a* is screw-engaged therewith or is engaged therewith using the fixing recesses 125 and the elastic fixing pins 146.

In addition, although the vibration probe 120 according to the present invention is engaged with the vibration block 150 or 150*a* using the connecting member 140 or 140*a*, the bolt 126 disposed on the shaft 124 or 124*a* of the vibration probe 120 can be directly engaged with the vibration block 150 or 150*a*.

FIG. 8 is a top-plan view illustrating the configuration of the skin and scalp massaging first head illustrated in FIGS. 1 to 3.

Referring to FIG. 8, the scalp massaging head 110 has a plurality of protrusions 112 and 114 disposed on the scalp-abutting top surface 111 in order to massage the scalp.

According to the present embodiment, the protrusions 112 and 114 protrude in the shape of cones from the top surface of the head 110, and are arranged radially. The central protrusions 112 and the circumferential protrusions 114 have different sizes. The bottom surfaces of the protrusions 112 and 114 are substantially circular. The circumferential protrusions 114 on the top surface 111 have a larger cross-sectional area and a greater height than the central protrusions 112 on the top surface 111. Alternatively, the protrusions 112 and 114 may have uniform sizes and heights.

Subsequently, FIG. 9 is a block diagram, illustrating the configuration of the skin and scalp massaging apparatus according to the present invention.

Referring to FIG. 9, the skin and scalp massaging apparatus 100 or 100*a* according to the present invention includes the vibration probe 120 or 120*a*, the vibration block 150 or 150*a*, the input part 106 or 106*a*, the display part 132, a sound source 200, a power supply 136, and a control part 134.

As described above, the skin and scalp massaging head 110 or 110*a* is detachably attached to the vibration probe 120 or 120*a* according to a variety of applications. The vibration probe 120 or 120*a* is engaged with the central portion of the conduit damper 170 of the vibration block 150 or 150*a* that generates vibration via the connecting member 140 or 140*a*, such that vibration is transmitted to the vibration probe 120 or 120*a*.

The input part 106 or 106*a* includes a plurality of input buttons, such that a user operates the skin and scalp massaging apparatus 100 or 100*a* by manipulating the buttons of the input part 106 or 106*a*. The display part 132 is implemented as a display module, and includes at least one LED. Alternatively the display part 132 may be implemented as a liquid crystal display (LCD) panel.

The sound source 200 is implemented as a portable memory device or an interface device receiving sound from an external sound generating device. The sound source 200 allows the vibration block 150 or 150*a* to generate vibration from sound. Examples of the external sound generating device may include a computer, a smartphone, an MP3 player, a portable media player (PMF), a compact disk (CD) player, and a digital TV. The interface device may be implemented as one selected from among a universal serial bus (USB) memory socket, a portable memory socket, an auxiliary (AUX) receiver able to transmit data using wired/wireless, communications networks, a USB connector, a WiFi receiver, a Bluetooth receiver, and the like.

The power supply 136 is implemented as, for example, a rechargeable battery that can be charged using electric power supplied from an external power source. The power supply 136 supplies power to the skin and scalp massaging apparatus 100 or 100*a* under the control of the control part 134.

The control part 134 is implemented as the control circuit board 134 to control the overall operations of the skin and scalp massaging apparatus 100 or 100*a*. The control part 101 controls power to be supplied to skin and scalp massaging apparatus 100 from the external power source or the power supply 136, and controls the operations of the skin and scalp massaging apparatus 100 to be performed in response to signals output by the input part 106 or 106*a*. In addition, the control part 134 controls the display module 132 to display various types of information in response to the operating states of the skin and scalp massaging apparatus 100.

As set forth above, the skin and scalp massaging apparatus 100 or 100*a* according to the present invention includes the vibration block 150 or 150*a* generating vibration from sound, the vibration probe 120 or 120*a* directly receives vibration from the vibration block 150 or 150*a*, and the plurality of heads 110 and 110*a* detachably attached to the vibration probe 120 or 120*a*.

The skin and scalp massaging apparatus 100 or 100*a* according to the present invention further includes the conduit damper 170 generating vibration in the vibration block 150 or 150*a*, In which the connecting member 140 or 140*a* is engaged with the central portion of the conduit damper 170, such that vibration is transmitted to the vibration probe 120 or 120*a* via the connecting member 140 or 140*a*.

Although the configurations and operations of the skin and scalp massaging apparatus according to the present invention have been disclosed with reference to the detailed description and the drawings, they are merely illustrations of the embodiments. Various modifications and alterations are possible, without departing from the scope and spirit of the present invention.

The invention claimed is:

1. A skin and scalp massaging apparatus using acoustic pressure, comprising:

a housing;

a vibration block disposed in an inner space of the housing and comprising a conduit damper, wherein the conduit damper comprises:

a disk-shaped conduit plate generating vibration in a vertical direction in response to changes in acoustic pressure generated from sound; and a plurality of strip-shaped dampers extending along a circumference of the conduit plate;

a vibration probe engaged with the vibration block to be exposed externally from the housing;

a connecting member transmitting the vibration generated by the vibration block to the vibration probe, wherein one end of the connecting member is engaged with the vibration probe, and another end of the connecting member is engaged with a central portion of the conduit damper; and a head detachably attached to the vibration probe to massage skin or scalp of a human body using the vibration received from the vibration probe.

2. The skin and scalp massaging apparatus according to claim 1, wherein the vibration probe comprises:

a plate to which the head is detachably attached; and a shaft disposed on a central portion of a bottom surface of the plate, a bottom end of the shaft being engaged with the connecting member.

3. The skin and scalp massaging apparatus according to claim 2, wherein the vibration block further comprises:

a body comprising a lower body having an opened upper portion and an inner accommodation space, and an upper body covering the opened upper portion of the lower body, the upper body having a first engagement hole through which the connecting member extends to be fitted thereinto;

a magnetic member disposed within the inner accommodation space to generate magnetic force;

a voice coil disposed around the magnetic member within the inner accommodation space;

an upper plate having a second engagement hole corresponding to the first engagement hole, the connecting member being engaged with the second engagement hole, wherein the, upper plate is disposed on top of the voice coil to induce magnetic force from the magnetic member to be concentrated on the voice coil; and the conduit damper having a third engagement hole corresponding to the second engagement hole, the connecting member being engaged with the third engagement hole, wherein the conduit damper is disposed on top of the upper plate and engaged between the upper body and the lower body to generate vibration in a vertical direction using an interaction between the magnetic member and the voice coil.

4. The skin and scalp massaging apparatus according to claim 3, wherein an upper portion of the connecting member is screw-engaged with the bottom end of the shaft, and a lower portion of the connecting member is engaged with the third engagement hole of the conduit damper and the second engagement hole of the upper plate.

5. The skin and scalp massaging apparatus according to claim 2, wherein the vibration block comprises:

a body comprising a lower body having an opened upper portion and an inner accommodation space, and an upper body covering the opened upper portion of the lower body, the upper body having a first engagement hole through which the connecting member extends to be fitted thereinto;

a lower bracket disposed in the inner accommodation space of the body, with upper and lower portions of the lower bracket being opened;

a magnetic member disposed within the inner accommodation space to generate magnetic force;

a voice coil disposed around the magnetic member within the inner accommodation space;

an upper plate disposed on top of the voice coil to induce magnetic force from the magnetic member to be concentrated on the voice coil;

a bobbin having, a second engagement hole in a central portion of an upper surface thereof, the connecting member being engaged with the second engagement hole, wherein the bobbin guides the voice coil to be disposed around the magnetic member;

the conduit damper having a third engagement hole corresponding to the second engagement hole, the connecting member being engaged with the third engagement hole, wherein the conduit damper is disposed on top of the upper plate to generate vibration in a vertical direction using an interaction between the magnetic member and the voice coil; and an upper bracket engaged with the lower bracket and disposed within the inner accommodation space of the body, the upper bracket having a fourth engagement hole corresponding to the third engagement hole, the connecting member being fitted into and extending through the fourth engagement hole.

6. The skin and scalp massaging apparatus according to claim 5, wherein each of the dampers is an arc-shaped strip that is curved outward, and has a screw-engagement hole in a distal end thereof, and wherein the dampers are fixedly engaged between the upper bracket and the lower bracket.

7. The skin and scalp massaging apparatus according to claim 6, wherein an upper portion of the connecting member is screw-engaged with the bottom end of the shaft, and wherein a lower portion of the connecting member is screw-engaged with the upper bracket through the fourth engagement hole, the conduit damper through the third engagement hole, and the bobbin through the second engagement hole, using a bolt at the lower portion of the connecting member.

8. The skin and scalp massaging apparatus according to claim 2, wherein the vibration probe has a fixing recess formed in a predetermined position on an outer circumference of the shaft, wherein the connecting member has an engagement recess in an upper portion thereof into which the shaft is removably fitted, and wherein an elastic fixing pin is fixedly disposed on the connecting member, and seated in or separated from the fixing recess when the shaft is fitted into or separated from the engagement recess.

* * * * *